US005082180A

United States Patent [19]

Kubo et al.

[11] Patent Number: 5,082,180

[45] Date of Patent: Jan. 21, 1992

[54] ELECTROMAGNETIC VALVE AND UNIT FUEL INJECTOR WITH ELECTROMAGNETIC VALVE

[75] Inventors: Ken-ichi Kubo; Xin-he Li, both of Higashimatsuyama, Japan

[73] Assignee: Diesel Kiki Co., Ltd., Tokyo, Japan

[21] Appl. No.: 453,903

[22] Filed: Dec. 20, 1989

[30] Foreign Application Priority Data

Dec. 28, 1988 [JP] Japan ..... 63-329278
Apr. 27, 1989 [JP] Japan ..... 1-105897

[51] Int. Cl.[5] ..... F02M 47/02

[52] U.S. Cl. ..... 239/88; 239/90; 239/124; 239/585; 251/129.07

[58] Field of Search ..... 251/129.07, 282; 239/88, 89, 90, 91, 93, 95, 125, 585, 124, 127

[56] References Cited

U.S. PATENT DOCUMENTS 3,247,833 4/1966 Beddoes et al. ..... 239/95
3,379,374 4/1968 Mekkes ..... 239/90
3,680,782 8/1972 Monpetit et al. ..... 239/585
4,385,339 5/1983 Takada et al. ..... 239/585
4,402,456 9/1983 Schneider ..... 239/125
4,418,867 12/1983 Sisson ..... 239/125
4,470,545 9/1984 Deckard et al. ..... 239/88
4,540,122 9/1985 Teerman ..... 239/585
4,544,096 10/1985 Burnett ..... 239/88
4,550,875 11/1985 Teerman et al. ..... 239/125
4,653,455 3/1987 Eblen et al. .
4,899,935 2/1990 Yoshida et al. ..... 239/91
4,941,612 7/1990 Li ..... 239/585

*Primary Examiner*—Andres Kashnikow
*Assistant Examiner*—Christopher G. Trainor

[57] ABSTRACT

An electromagnetic valve includes a tubular valve member fitted on a cylindrical guide member for sliding movement therealong. The guide member has an axial introduction passage leading to a valve seat of the valve member via a communication passage. When the valve member is disengaged from the valve seat, a high-pressure fluid in the introduction passage is spilled into a low pressure chamber provided around the guide member. The electromagnetic valve is incorporated in a unit fuel injector so as to control the spilling of the fuel pressurized by a pump mechanism. In the unit fuel injector, the pump mechanism, the electromagnetic valve and an injection nozzle mechanism are mounted on a linearly-extending body and disposed on the axis of said body. A plunger of the pump mechanism and a nozzle of the injection nozzle mechanism extend along the axis of the body. The electromagnetic valve is disposed between the pump mechanism and the injection nozzle mechanism.

14 Claims, 4 Drawing Sheets

ELECTROMAGNETIC VALVE AND UNIT FUEL INJECTOR WITH ELECTROMAGNETIC VALVE

BACKGROUND OF THE INVENTION

This invention relates to an electromagnetic valve best suited for spilling a high-pressure fluid and to a unit fuel injector incorporating such an electromagnetic valve.

U.S. Pat. Nos. 4,392,612, 4,463,900, 4,470,545, 4,485,969, 4,527,737 and 4,618,095 disclose unit fuel injectors for injecting fuel into an engine such as a diesel engine. Such a unit fuel injector comprises a pump mechanism, an injection nozzle mechanism, and an electromagnetic valve all of which are incorporated in a body of the fuel injector, the unit fuel injector being mounted directly on the engine.

The pump mechanism includes a plunger received in a hole in the injector body so as to reciprocally move therealong, and a pump chamber whose volume is changed with the reciprocal movement of the plunger.

The injection nozzle mechanism includes injection ports communicating with the pump chamber via a fuel feed passage, and a valve disposed between the pump and the injection ports. When the pressure of fuel within the pump chamber increases to a high level during the advance or pump stroke of the plunger which decreases the volume of the pump chamber, the valve is opened to inject the fuel from the injection ports.

The electromagnetic valve controls the relief of the fuel pressure within the pump chamber during the pump stroke of the plunger so as to control the timing of terminating the fuel injection and, if necessary, the timing of starting the fuel injection. The electromagnetic valve includes a guide hole and a spill chamber both of which are formed in the injector body and communicate with each other. A valve seat is formed on one end surface of the guide hole facing the spill chamber. The electromagnetic valve also includes a poppet-type valve member which has a stem portion and a head formed at one end of the stem portion, the head being greater in diameter than the stem portion. The stem portion has an annular recess formed in its outer peripheral surface and disposed adjacent to the head. The stem portion is received in the guide hole for sliding movement therealong, so that an annular space is formed between the annular recess and the inner peripheral surface of the guide hole. This annular space communicates with the pump chamber via a spill passage formed in the injector body. The head of the valve member is disposed in the spill chamber, and is brought into and out of contact with the valve seat. The electromagnetic valve further includes an electromagnetic drive means for controlling the movement of the valve member. The electromagnetic drive means comprises an armature connected to the other end of the stem portion of the valve member, a solenoid for driving the armature so that the head of the valve member can be moved toward the valve seat, and a spring urging said valve member away from the valve seat.

In the above conventional unit fuel injector, when the solenoid is energized during the pump stroke of the plunger, the head of the valve member is brought into engagement with the valve seat, so that the communication of the spill chamber with the pump chamber is interrupted. As a result, the fuel within the pump chamber is pressurized and is injected from the injection nozzle mechanism.

When the solenoid is switched from its energized condition to its de-energized condition during the pump stroke of the plunger, the head of the valve member is brought out of contact with the valve seat under the influence of the spring. As a result, the high-pressure fuel within the pump chamber is spilled into the spill chamber, so that the pressure within the pump chamber decreases, thereby terminating the fuel injection.

When the head of the valve member is kept in sealing engagement with the valve seat, the pressure within the annular recess of the valve member is uniform, and besides the pressure receiving areas of the opposed side surfaces of the annular recess are equal to each other, so that the force due to the fuel pressure will not serve to move the valve member. However, at the moment when the head of the valve member is disengaged from the valve seat, the annular recess is communicated with the sill chamber, so that the fuel pressure within the annular recess becomes lower progressively toward the valve seat. In other words, the pressure acting on the side surface of the annular recess close to the valve seat is lower than the pressure acting on the other side surface remote from the valve seat. Because of this pressure difference, there develops a force to move the valve member in such a direction that the head of the valve member is moved toward the valve seat. Therefore, the speed of disengagement of the head from the valve seat becomes lower, so that the area of flow between the valve seat and the valve member can not be increased quickly. This retards a pressure drop in the pump chamber. As a result, the fuel injection operation can not be terminated at a time, and the problem of subsequent dripping of the fuel can not be positively overcome.

In the unit fuel injector disclosed in the aforesaid U.S. Pat. No. 4,470,545, a flange is formed on the valve member, and this flange receives the kinetic energy of the spilled fuel when the valve member is moved in its opening direction. Further, in a unit fuel injector disclosed in U.S. patent application Ser. No. 395,432 filed Aug. 17, 1989 by the Applicant of the present application, a flange is formed on a valve member, and the pressure of the spilled fuel is applied to the flange when the valve member is moved in its opening direction, and the force due to this fuel pressure serves to move the valve member in its opening direction. Further, in a unit fuel injector disclosed in U.S. patent application Ser. No. 390,893 filed Aug. 8, 1989 by the Applicant of the present application, means is provided for communicating a spill chamber with a tank of a low pressure.

The unit fuel injectors of the aforesaid U. S. patents suffer from another problem. More specifically, the injector body has a first portion extending vertically, and a second portion extending laterally from the upper section of the first portion. The pump mechanism is mounted on the upper end section of the first portion, and the injection nozzle mechanism is mounted on the lower end section of the first portion. The electromagnetic valve is mounted on the second portion. In such a construction, since the second portion of the injector body is projected laterally, the injector body occupies much space in the vicinity of the engine, and therefore reduces the space used for mounting other parts.

As is clear from the foregoing description, when the fuel pressure within the pump chamber increases, the fuel pressure within the long spill passage connected between the electromagnetic valve and the pump chamber, as well as the fuel pressure within the fuel feed passage connected between the pump chamber and the injection ports, increases. Therefore, the spill passage constitutes a dead space when the fuel is pressurized, and thus prevents the fuel from being pressurized to a sufficiently high level. Another problem is that considerable time and labor are required to form such a spill passage in the injector body, which increases the manufacturing cost.

Further, in unit fuel injectors disclosed in U.S. Pat. Nos. 4,622,942 and 4,674,461, a pump mechanism is mounted on an upper end portion of a body, and an injection nozzle mechanism is mounted on a lower end portion of the body, and an electromagnetic valve is mounted on a portion extending laterally from the body intermediate the opposite ends of the body. This unit fuel injector also suffers from the same drawbacks as described for the above-mentioned unit fuel injectors.

Further, in a unit fuel injector disclosed in Japanese Laid-Open Utility Model Application No. 115589/87, an electromagnetic valve, a pump mechanism and an injection nozzle mechanism are mounted on a vertically-extending body and disposed on the axis of the body. However, this conventional unit fuel injector differs from the unit fuel injectors of the present invention in that the electromagnetic valve is mounted on the upper end of the body, with the pump mechanism disposed between the electromagnetic valve and the injection nozzle mechanism, and that a plunger of the pump mechanism is disposed perpendicular to the axis of the body, so that during the reciprocal movement of the plunger, the body is subjected to vibrations in the direction perpendicular to the axis of the body.

SUMMARY OF THE INVENTION

It is therefore an object of this invention to provide an electromagnetic valve which can prevent a valve member from being urged toward a valve seat by a fluid of a high pressure when the valve is opened, thereby enabling the valve member to be moved at high speed in a valve-opening direction.

Another object is to provide a unit fuel injector which can terminate the fuel injection operation at a time, using such an electromagnetic valve.

A further object is to provide a unit fuel injector which is space-saving, and can pressurize the fuel to a higher level, and is simple in construction, and can be manufactured at lower costs.

According to a first aspect of the invention, there is provided an electromagnetic valve comprising:

(a) a casing having an internal space serving as a low pressure chamber;

(b) a guide member mounted within the casing and having a cylindrical stem portion and a valve seat disposed radially outwardly of the stem portion, the stem portion having an introduction passage extending along an axis of the stem portion so as to receive a high-pressure fluid, and a communication passage leading the introduction passage to the valve seat;

(c) a valve member having a tubular portion which is fitted on the stem portion for sliding movement therealong in a direction of the axis of the guide member, the tubular portion having at one end an abutment portion disposed in opposed relation to the valve seat, the valve member being movable along the axis of the guide member between a closed position where the abutment portion is held in contact with the valve seat to interrupt the communication between the introduction passage and the low pressure chamber and an open position where the abutment portion is held out of contact with the valve seat to communicate the introduction passage with the low pressure chamber via the communication passage, and the high-pressure fluid in the introduction chamber being spilled into the low pressure chamber during the time when the valve member is moved from its closed to open position; and (d) electromagnetic drive means for controlling the movement of the valve member, the electromagnetic drive means including a spring urging the valve member in one of a direction toward the closed position and a direction away from the closed position, and a solenoid for urging the valve member in the other direction.

According to a second aspect of the invention, there is provided unit fuel injector comprising:

(a) a body;

(b) pump means mounted on the body, the pump means including a cylinder hole formed in the body, and a plunger received in the cylinder hole for reciprocal movement therealong to achieve a pump stroke and a suction stroke, a pump chamber being defined by the cylinder hole and the plunger;

(c) injection nozzle means mounted on the body and including an injection port connected to the pump chamber, and a valve for controlling the communication between the pump camber and the injection port, the valve being opened when the pressure of fuel within the pump chamber is increased to a predetermined level during the pump stroke, thereby injecting the fuel from the injection port; and (d) an electromagnetic valve mounted on the body and including (i) a low pressure chamber formed in the body; (ii) a guide member mounted within the low pressure chamber and having a cylindrical stem portion and a head of a circular cross-section which is formed on one end of the stem portion and is greater in diameter than the stem portion, that surface of the head close to the stem portion serving as an annular valve seat, an end face of the stem portion remote from the head being abutted against part of a surface defining the low pressure chamber, the stem portion having an introduction passage extending along an axis of the stem portion, the introduction passage having one end disposed in the vicinity of the head, the introduction passage opening at the other end to the end face of the stem portion, the other end of the introduction passage communicating with the pump chamber via a spill passage formed in the body so that a high-pressure fluid from the pump chamber can be introduced into the introduction passage, and the stem portion having an annular recess formed in the outer peripheral surface thereof adjacent to the head, and a transverse hole extending generally radially of the stem portion and communicating the one end of the introduction passage with the annular recess; (iii) a valve member having a tubular portion which is fitted on the stem portion for sliding movement therealong in a direction of the axis of the guide member, the tubular portion having at one end an annular abutment portion disposed in opposed relation to the annular valve seat, the valve member being movable along the axis of the guide member between a closed position where the abutment portion is held in contact with the valve seat to interrupt the communication between the introduction passage and the low pressure chamber and an open position where the abutment portion is held out of contact with the valve seat to communicate the introduction passage with the low pressure chamber via the transverse hole and the annular recess, whereby immediately the valve member moves from its close position toward its open position during the pump stroke of the plunger, the high-pressure fluid in the pump chamber is spilled into the low pressure chamber via the introduction passage, the transverse hole and the annular recess, thereby terminating the injection of the fuel from the injection port; and (iv) electromagnetic drive means for controlling the movement of the valve member, the electromagnetic drive means including a coil spring urging the valve member in one of a direction toward the closed position and a direction away from the closed position, and a solenoid for urging the valve member in the other direction.

According to a third aspect of the invention, there is provided a unit fuel injector comprising:

(a) a linearly-extending body;

(b) pump means mounted on one end portion of the body, the pump means including a cylinder hole formed in the body and extending along the axis of the body, and a plunger received in the cylinder hole for reciprocal movement therealong to achieve a pump stroke and a suction stroke, a pump chamber being defined by the cylinder hole and the plunger, the plunger being generally coaxial with the body;

(c) injection nozzle means mounted on the other end of the body, the injection nozzle means including a nozzle extending along the axis of the body and having at its distal end an injection port connected to the pump chamber via a fuel feed passage, and a valve for controlling the communication between the pump camber and the injection port, the valve being opened when the pressure of fuel within the pump chamber is increased to a predetermined level during the pump stroke, thereby injecting the fuel from the injection port; and (d) an electromagnetic valve mounted within the body so as to spill the high-pressure fuel from the pump chamber, the electromagnetic valve being disposed on the axis of the body and being disposed between the pump means and the injection nozzle means.

DESCRIPTION OF THE PREFERRED EMBODIMENTS OF THE INVENTION

One preferred embodiment of a unit fuel injector of the present invention will now be described with reference to FIG. 1.

Figure 1:
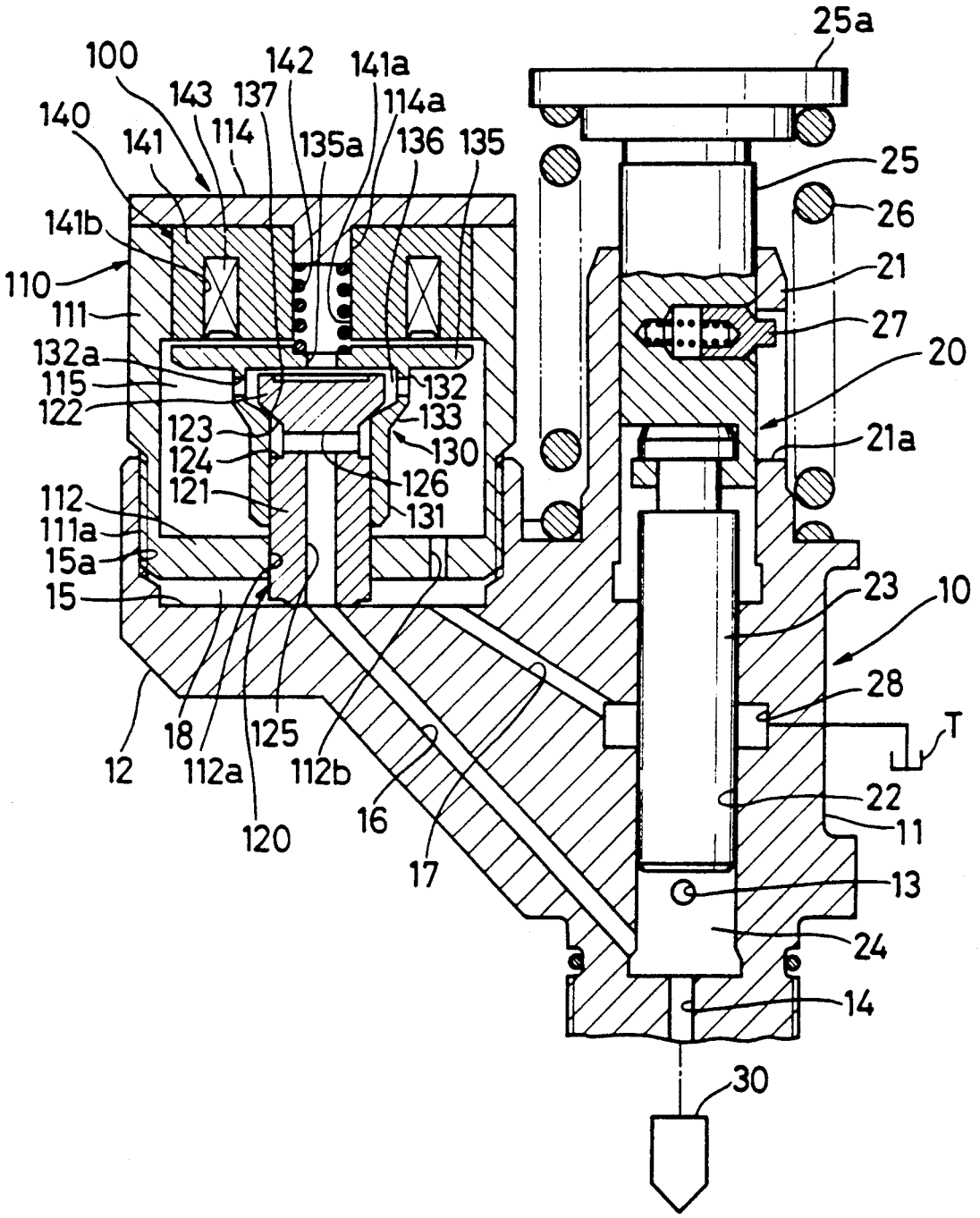
FIG. 1 is a cross-sectional view of a portion of a unit fuel injector of the present invention incorporating an electromagnetic valve.

The unit fuel injector shown in FIG. 1 comprises a body 10 which has a vertically-extending first portion 11 and a second portion 12 extending generally laterally from the upper section of the first portion 11. A pump mechanism 20 for pressurizing fuel is mounted on the upper section of the first portion 11, and an injection nozzle mechanism 30 for injecting the pressurized fuel into a cylinder of an engine (not shown) is mounted on the lower section of the first portion 11. An electromagnetic valve 100 for controlling the timing of terminating the fuel injection is mounted on the second portion 12.

First, the pump mechanism 20 will now be described in detail. The first portion 11 of the body 10 has a tubular portion 21 extending vertically upwardly, and a cylinder hole 22 formed in the first portion 11 i coaxial relation to the tubular portion 21. The diameter of the cylinder hole 22 is smaller than the inner diameter of the tubular portion 21, and the cylinder hole 22 is slightly enlarged in diameter at its lower end. A plunger 23 is received in the cylinder hole 22 so as to reciprocally move therealong. The lower end face of the plunger 23 defines, together with the cylinder hole 22, a pump chamber 24. As the plunger 23 moves downward (an advance or pump stroke), the volume of the pump chamber 24 is decreased so as to pressurize the fuel in the pump chamber 24. As the plunger 23 moves upward (a return or suction stroke), the volume of the pump chamber 24 is increased to introduce the fuel into the pump chamber 24 by suction.

A follower member 25 is received in the tubular portion 21 for sliding movement therealong. The lower end of the follower member 25 is connected to the upper end of the plunger 23. The follower member 25 has at its upper end an enlarged diameter portion 25*a*. The follower member 25 is urged upward by a coil spring 26 acting between the enlarged diameter portion 25*a* and the upper surface of the body 10, so that the upper surface of the enlarged diameter portion 25*a* is always held in contact with a cam portion of a cam shaft rotated by the engine. In response to the rotation of the cam shaft, the follower member 25 is moved upward and downward together with the plunger 23. A limit member 27 is mounted on the follower member 25, and is slidably received in a vertical slot 21*a* formed through the tubular portion 21. The limit member 27 is brought into engagement with the upper end of the slot 21*a* to limit the upward movement of the follower member 25 and hence to prevent the follower member 25 from becoming disengaged upwardly from the tubular portion 21.

A leakage prevention groove 28 of an annular shape is formed in the inner peripheral surface of the cylinder hole 22 intermediate the opposite ends of the cylinder hole 22, the leakage prevention groove 28 serving to prevent the fuel, contained in the pump chamber 24, from leaking to the exterior through a gap between the inner peripheral surface of the cylinder hole 22 and the outer peripheral surface of the plunger 23. The leakage prevention groove 28 is in communication with a tank T via a passage (not shown) formed in the body 10.

A fuel supply passage 13 is formed in the first portion 11 of the body 10. The fuel supply passage 13 communicates at one end with the pump chamber 24, and opens at the other end to the outer peripheral surface of the first portion 11. The other end of the fuel supply passage 13 is connected to a fuel supply pump (not shown) via a pipe. The one end of the fuel supply passage 13 opening to the pump chamber 24 is disposed at a level or height higher by a predetermined amount than the bottom surface of the pump chamber 24.

The lower section of the first portion 11 of the body 10 as well as the injection nozzle mechanism 30 is well known in the art, for example, from the above-mentioned U. S. patents, and besides these portions are similar to those of a modified unit fuel injector later described with reference to FIG. 4. Therefore, these portions are not shown in detail in FIG. 1. Briefly, the injection nozzle mechanism 30 has at its distal end injection ports, and a spring-biased valve for opening and closing these injection ports. The injection ports communicate with the pump chamber 24 via a fuel feed passage 14 through which the fuel of high pressure flows. The fuel feed passage 14 opens at its upper end to the bottom surface of the pump chamber 24.

A receptive recess 15 for receiving the electromagnetic valve 100 is formed in the upper surface of the second portion 12 of the body 10. The receptive recess 15 has an internally-threaded portion 15*a* at its inner peripheral surface.

A spill passage 16 into which the fuel of high pressure is introduced is formed in the body 10. The spill passage 16 extends obliquely upwardly from the lower end portion of the pump chamber 24, and opens at its upper end to the central portion of the bottom surface of the receptive recess 15. Also formed in the body 10 is a leakage passage 17 which extends obliquely upwardly from the leakage prevention groove 28 and opens at its upper end to the bottom surface of the receptive recess 15 in eccentric relation to the center of this bottom surface.

Next, the electromagnetic valve 100 will now be described in detail. The electromagnetic valve 100 comprises a casing 110 which constitutes part of the body 10, the casing 110 having a cylindrical portion 111 and a bottom wall 112 formed at the lower end of the cylindrical portion 111. An externally-threaded portion 111*a* is formed on the outer peripheral surface of the cylindrical portion 111 at the lower end portion thereof. A mounting hole 112*a* is formed through the bottom wall 112 at the central portion thereof, and a communication hole 112*b* is formed through the bottom wall 112 in eccentric relation to the center of the bottom wall 112. An upper open end of the cylindrical portion 111 is closed by a lid 114. The internal space or interior of the casing 110 serves as a low pressure chamber 115.

A guide member 120 is mounted within the casing 110. The guide member 120 has a vertically-extending stem portion 121 of a cylindrical shape and a head 122 of a circular cross-section formed on the upper end of the stem portion 121, the diameter of the head 122 being greater than the diameter of the stem portion 121. The stem portion 121 extends at its lower portion through the mounting hole 112*a* of the bottom wall 112 of the casing 110 and is fixed relative thereto. The lower end of the stem portion 121 is projected downwardly from the bottom wall 112.

The head 122 has a lower portion which is tapering downward, that is, decreases in diameter progressively downward, and this tapered peripheral surface of the lower portion of the head 122 serves as a valve seat 123. An annular recess 124 is formed in the outer peripheral surface of the stem portion 121 and disposed adjacent to the head 122, an upper one of the opposed side surfaces of the annular recess 124 being continuous with the valve seat 123.

An introduction passage 125 is formed in the guide member 120, and extends along the axis of the guide member 120. The introduction passage 125 opens at its lower end to the lower end face of the stem portion 121 at a central portion thereof. The introduction passage 125 extends upwardly up to the upper end of the stem portion 121, and does not extend as far as the head 122. The upper end of the introduction passage 125 communicates with the annular groove 124 via a transverse hole 126 extending radially through the stem portion 121.

A valve member 130 is accommodated within the casing 110. The valve member 130 has a tubular portion 131 slidably fitted on the stem portion 121 of the guide member 120. An auxiliary tubular portion 132 greater in diameter than the tubular portion 131 is connected to the upper end of the tubular portion 131 through a funnel-shaped connective portion 133. A disc-shaped armature 135 is formed on the upper end of the auxiliary tubular portion 132, the armature 135 having a central hole 135*a* formed therethrough. The armature 135 extends radially outwardly and inwardly from the upper end of the auxiliary tubular portion 132.

The head 122 of the guide member 120 is received within a space 136 formed by the auxiliary tubular portion 132, the connective portion 133 and the inner side of the armature 135. The space 136 is in communication with the low pressure chamber 115 of the casing 110 via holes 132*a*, formed through the auxiliary tubular portion 132, and the central hole 135*a* of the armature 135.

The angle of inclination of the inner tapered surface of the connective portion 133 with respect to the axis of the valve member 130 is greater than the angle of inclination of the valve seat 123 with respect to the axis of the guide member 120. The valve member 130 and the guide member 120 are coaxial with each other. The inner peripheral edge of the upper end of the tubular portion 131 serves as an annular abutment portion 137 which is brought into and out of contact with the valve seat 123 of the guide member 120.

An electromagnetic drive means 140 is received in the upper end portion of the casing 110. The electromagnetic drive means 140 includes a stator 141 fixedly secured to the upper end portion of the cylindrical portion 111 of the casing 110, the lower surface of the stator 141 facing the upper surface of the armature 135. The stator 141 has a vertically-extending central hole 141*a* therethrough, and a central boss 114*a* formed on the lower surface of the lid 114 is fitted in the central hole 141*a*. A coil spring 142 is received in the central hole 141*a* and extends between the lower end of the boss 114*a* and the upper surface of the armature 135 in a compressed condition. The coil spring 142 urges the valve member 130 downward so that the abutment portion 137 is urged away from the valve seat 123 of the guide member 120. An annular recess 141*b* is formed in the stator 141 and opens to the lower surface of the stator 141, and a solenoid 143 is received in the annular recess 141*b*. When electrical current is supplied to the solenoid 143, an electromagnetic force is produced in the solenoid 143 and the stator 141 and attracts the armature 135 of the valve member 130 upwardly.

The electromagnetic valve 100 is mounted on the body 10 by threading the casing 110 into the receptive recess 15. In this mounted condition, the lower end face of the guide member 120 is held against the bottom surface of the receptive recess 15, and the lower end of the introduction passage 125 of the guide member 120 is registered with the upper end of the spill passage 16. Thus, the introduction passage 125 is communicated with the pump chamber 24 via the spill passage 16.

Also, in the above mounted condition, a small space 18 is formed between the lower surface of the bottom wall 112 of the casing 110 and the bottom surface of the receptive recess 15. Therefore, the low pressure chamber 115 of the casing 110 communicates with the leakage prevention groove 28 and hence the tank T via the communication hole 112*b*, the small space 18 and the leakage passage 17. Therefore, the low pressure chamber 115 of the casing 110 is kept at substantially the atmospheric pressure.

In the unit fuel injector of the above construction, when the plunger 23 is disposed in the vicinity of its upper dead point, electrical current is supplied to the solenoid 143. As a result, the valve member 130 moves upward against the bias of the spring 142, so that the abutment portion 137 of the valve member 130 is brought into contact with the valve seat 123, this contact being an edge-to-face contact. In this condition, the communication between the introduction passage 125 and the space 136 is interrupted, and therefore the communication between the pump chamber 24 and the low pressure chamber 115 is interrupted.

As the plunger 23 moves downward, the plunger 23 closes the one end of the fuel supply passage 13 opening to the pump chamber 24. Then, when the plunger 23 further moves downward, the fuel in the pump chamber 24 is pressurized. The thus pressurized fuel is fed under pressure to the injection nozzle mechanism 30 via the fuel feed passage 14, and is injected into a combustion chamber (not shown) of the engine. The operation of the injection nozzle mechanism 30 will be hereinafter described with respect to the unit fuel injector of FIG. 4, and therefore will not be described here.

When the energization of the solenoid 143 is stopped during the downward stroke of the plunger 23, the valve member 130 is urged downward under the influence of the coil spring 142, so that the abutment portion 137 is disengaged from the valve seat 123. As a result, the pump chamber 24 is communicated with the low pressure chamber 115 of the casing 110 via the spill passage 16, the introduction passage 125, the transverse hole 126, the annular recess 124, the space 136, the holes 132*a* and the hole 135*a*. Therefore, part of the fuel of high pressure, contained in the pump chamber 24, the spill passage 16, the introduction passage 125, the transverse hole 126 and the annular recess 124, is spilled into the low pressure chamber 115, so that the pressure within the pump chamber 24 is lowered, and the fuel injection operation is finished or terminated.

The valve member 130, moving in the direction to open the valve as described above, is stopped when the armature 135 is brought into engagement with the upper surface of the head 122 of the guide member 120.

At the moment when the abutment portion 137 of the valve member 130 begins to be disengaged from the valve seat 123 as described above, the pressure within the annular recess 124 is the lowest in the vicinity of the valve seat 123, and becomes higher progressively away from the valve seat 123.

Since the diameter of the tubular portion 131 of the valve member 130 is uniform over the entire length thereof, the valve member 130 is not influenced by the above pressure gradient at all. In other words, the valve member 130 does not have any surface for receiving the pressure causing the valve member 130 to move axially. Therefore, the valve member 130 performs the valve opening operation substantially only under the bias of the spring 142.

As compared with the above-mentioned conventional electromagnetic valves in which when the fuel is spilled, a pressure gradient develops in the annular recess, formed in the valve member, to produce a force causing the valve member to move in its closing direction, the electromagnetic valve 100 of FIG. 1 is advantageous in that the valve member 130 can be moved under the influence of the spring 142 in the valve opening direction at a higher speed. As a result, the fuel injection operation can be terminated at a time.

Figure 2:
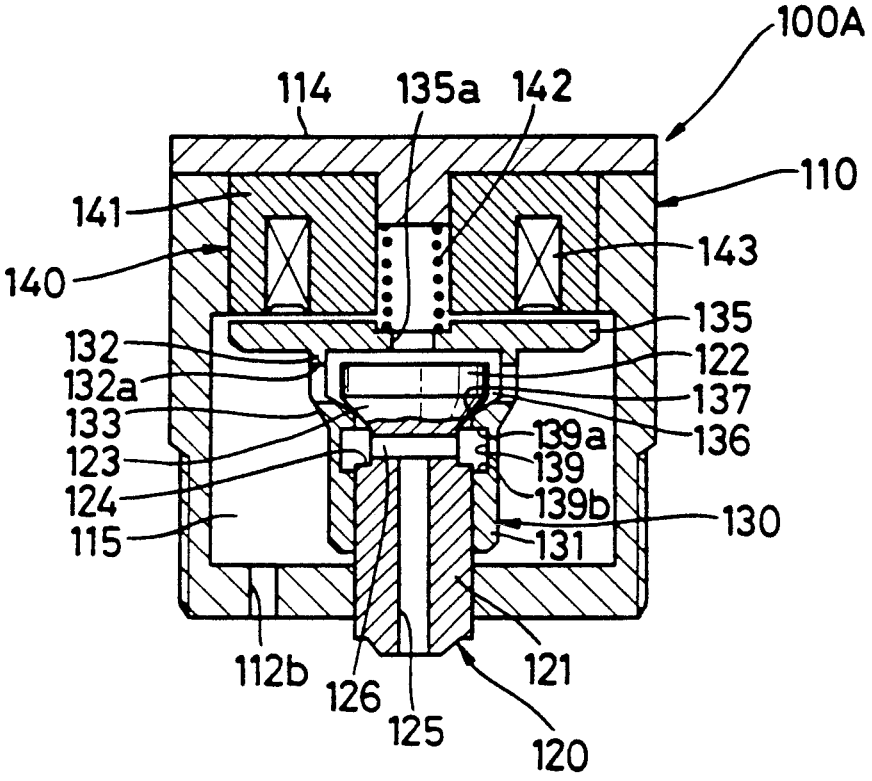
FIGS. 2 and 3 are cross-sectional views of modified electromagnetic valves, respectively.

With respect to the unit fuel injector of FIG. 1, the electromagnetic valve 100 may be replaced by an electromagnetic valve 100A of FIG. 2. The electromagnetic valve 100A is similar in construction to the electromagnetic valve 100 of FIG. 1, and the same or corresponding parts are designated by identical reference numerals, respectively, and will not be described in detail further. The different parts will now be described. In the electromagnetic valve 100A, an annular recess 139 is formed in the inner peripheral surface of the tubular portion 131 of the valve member 130 in opposed relation to the annular recess 124 of the guide member 120. The annular recess 139 is defined by a pair of upper and lower annular side surfaces or shoulders 139*a* and 139*b* disposed in parallel opposed relation to each other, and a bottom surface interconnecting the upper and lower shoulders 139*a* and 139*b* at their one ends. The upper and lower shoulders 139*a* and 139*b* serve as pressure-receiving surfaces. When the abutment portion 137 of the valve member 130 is held in contact with the valve seat 123, the fuel pressure within the annular recess 139 is uniform, and the pressure receiving areas of the shoulders 139*a* and 139*b* are equal to each other. Therefore, the valve member 130 is not subjected to any axial force due to the fuel pressure. As described above, at the moment when the abutment portion 137 of the valve member 130 begins to be disengaged from the valve seat 123, the pressure in the annular recess 139 is lower in the vicinity of the valve seat 123 and becomes higher progressively away from the valve seat 123. Therefore, the pressure acting on the lower shoulder 139*b* is higher than the pressure acting on the upper shoulder 139*a*, and the force due to this pressure difference urges the valve member 130 downward. As a result, the valve member 130 of the electromagnetic valve 100A is moved in the valve opening direction at a higher speed than the valve member 130 of the electromagnetic valve 100 of FIG. 1. In other words, in the electromagnetic valve 100A, the pressure gradient developing in the annular recess 139 is positively utilized to obtain the force for propelling the valve member 130 when the valve is to be opened.

Figure 3:
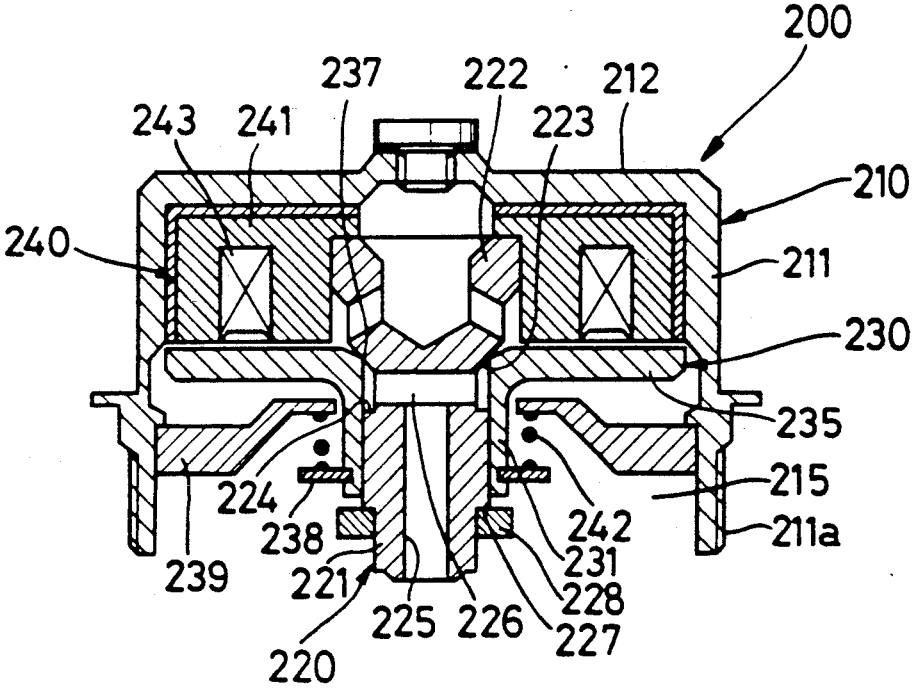

Also, with respect to the unit fuel injector of FIG. 1, the electromagnetic valve 100 may be replaced by an electromagnetic valve 200 of FIG. 3. A casing 210 of the electromagnetic valve 200 has a cylindrical portion 211 and an upper end wall 212 closing the upper end of the cylindrical portion 211. An externally-threaded portion 211*a* for threaded connection to the receptive recess 15 is formed on the outer peripheral surface of the cylindrical portion 211 at the lower end section thereof. An annular stator 241 having a solenoid 243 embedded therein is fixedly secured to the upper section of the cylindrical portion 211 and the upper wall 212.

In the electromagnetic valve 200, a guide member 220 includes a stem portion 221, and a head 222 formed on the upper end of the stem portion 221, the diameter of the head 222 being greater than the diameter of the stem portion 221. An annular valve seat 223 is formed o the head 222. The stem portion 221 has an introduction passage 225, a transverse hole 226 and an annular recess 224, as described above in the above embodiments. The outer peripheral surface of the stem portion 221 is stepped to provide an annular shoulder 227, and the lower section of the stem portion 221 extending downwardly from the shoulder 227 is smaller in diameter than the remainder, that is, the upper section thereof. An annular stop member 228 is fixedly mounted on said the lower section of a smaller diameter immediately adjacent to the shoulder 227.

In the electromagnetic valve 200, a valve member 230 has a tubular portion 231. The tubular portion 231 is slidably mounted on the upper section of the stem portion 221 extending upwardly from the shoulder 227. The inner peripheral edge of the upper end of the tubular portion 231 serves as an annular abutment portion 237. An annular armature 235 is formed on and extends radially outwardly from the upper end of the tubular portion 231. An annular spring retainer 238 is fixedly mounted on the lower end portion of the tubular portion 231. Another annular spring retainer 239 is fixedly secured to the inner peripheral surface of the cylindrical portion 211 of the casing 210. The inner peripheral edge of the spring retainer 239 is disposed between the spring retainer 238 and the armature 235, and a coil spring 242 is wound around the tubular portion 231 of the valve member 230 and acts between the two spring retainers 238 and 239.

As described above, in the electromagnetic valve 200, the solenoid 243 of an electromagnetic drive means 240 is disposed at the upper portion of the casing 210, and the spring 242 is disposed at the lower portion of the casing 210. Since the armature 235 does not need to perform the function of a spring retainer, the construction of the valve member 230 is simple.

When the electromagnetic valve 200 is mounted on the unit fuel injector of FIG. 1, a low pressure chamber 215 of the casing 210 communicates directly with the leakage passage 17.

The operation of the electromagnetic valve 200 is basically similar to that of the electromagnetic valve 100 of FIG. 1. Immediately the high-pressure fuel within the introduction passage 225 is spilled into the low pressure chamber 215 upon disengagement of the valve member 230 from the valve seat 223, the thus spilled fuel pressure is instantaneously applied to the upper surface of the armature 235, so that a force causing the valve member 230 to move away from the valve seat 223 is applied to the valve member 230, thereby quickly moving the valve member 230 in the valve opening direction.

In the electromagnetic valve 100 of FIG. 1, the armature 135 has the inner radial portion extending radially inwardly from the upper end of the auxiliary tubular portion 132, and the spilled fuel instantaneously impinges on the lower surface of this inner radial portion. Therefore, there is a possibility that a force tending to move the valve member 130 toward the valve seat 123 may be applied to the valve member 130. On the other hand, in the electromagnetic valve 200 of FIG. 3, since the armature 235 does not have such an inner radial portion extending radially inwardly from the upper end of the tubular portion 231, any force tending to move the valve member 230 toward the valve seat 223 is not applied to the valve member 230 when the fuel is spilled.

In the electromagnetic valve 200, the downward movement of the valve member 230 is limited by the engagement of the lower end of the valve member 230 with the stop member 228.

Figure 4:
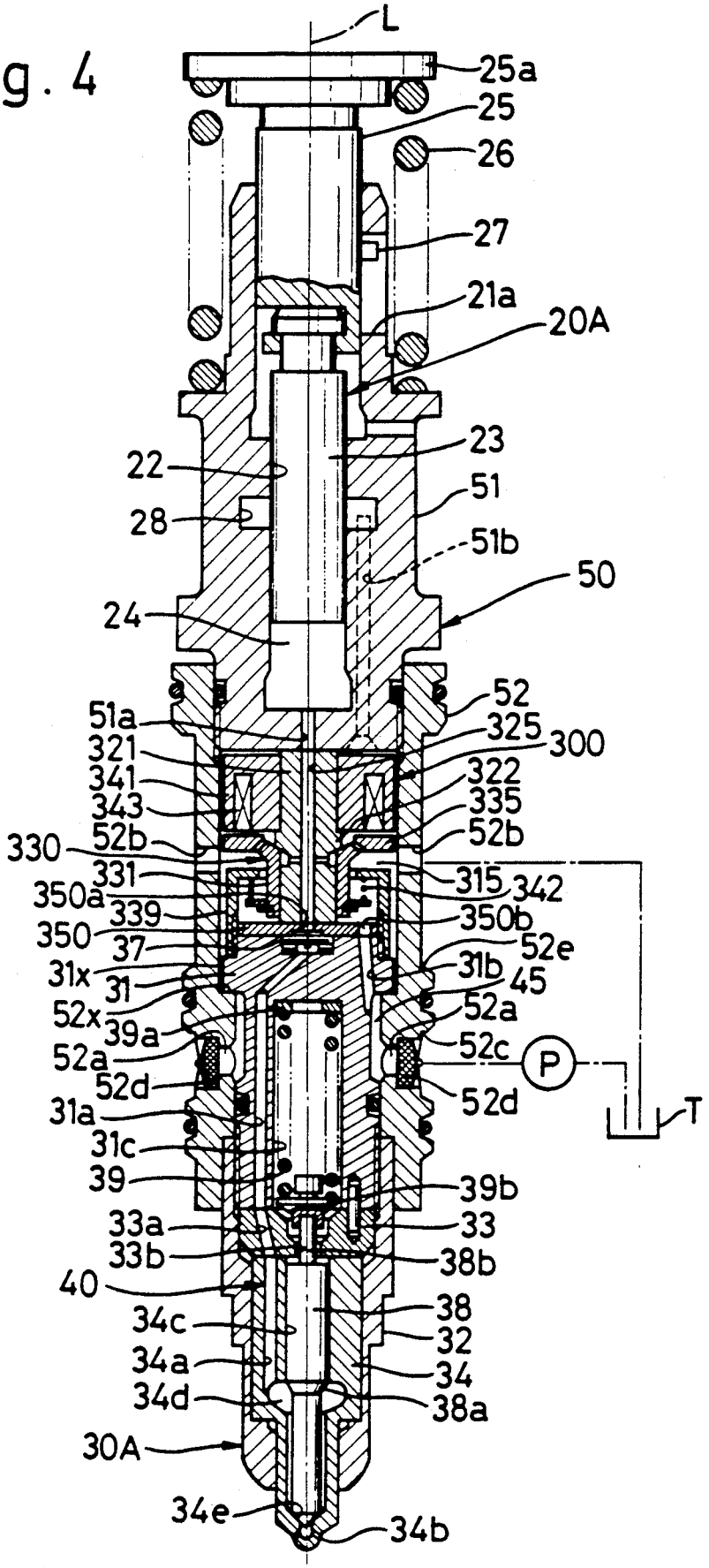
FIG. 4 is a cross-sectional view of a modified unit fuel injector.

FIG. 4 shows the modified unit fuel injector of the present invention. This unit fuel injector comprises a linearly-extending body 50. The body 50 comprises a hollow cylindrical base member 51 extending vertically, and a hollow cylindrical retainer 52 threadedly connected at its upper end to the lower end of the base member 51 in coaxial relation thereto. Thus, the body 50 has a cylindrical shape throughout the entire length thereof.

In downward sequence, a pump mechanism 20A, an electromagnetic valve 300 and an injection nozzle mechanism 30A are mounted on the body 50, and are disposed on a longitudinal axis or centerline L of the body 50.

The pump mechanism 20A is generally similar in construction to the pump mechanism 20 of FIG. 1, and is mounted on the base member 51 of the body 50. Those parts of the pump mechanism 20A corresponding to those of the pump mechanism 20 of FIG. 1 are designated by identical reference numerals, respectively, and will not be described further in detail. The axis or centerline of a plunger 23 of the pump mechanism 20A is aligned with the axis L of the body 50.

The injection nozzle mechanism 30A will now be described in detail. A spring holder 31 is received in the lower portion of the retainer 52, and an auxiliary retainer 32 is threadedly connected to the lower end of the spring holder 31. A spacer 33 and an injection nozzle 34 are received in the auxiliary retainer 32. The auxiliary retainer 32, the spring holder 31 and the injection nozzle 34 are coaxial with the body 50. The spring holder 31, the spacer 33 and the injection nozzle 34 are held in intimate contact with one another by tightly threading the auxiliary retainer 32 onto the spring holder 31. The retainer 52 is received in an accommodation hole, formed in a cylinder head of the engine, through a sleeve (not shown). The distal or lower end of the injection nozzle 34 is projected from the auxiliary retainer 32 into the cylinder of the engine.

The injection nozzle 34 has at its distal end injection ports **34*b*. A pump chamber 24 is in communication with the injection ports 34*b* via a fuel feed passage 40. The fuel feed passage 40 is constituted by a passage 51*a* formed in the base member 51 and opening at its upper end to the bottom surface of the pump chamber 24 and extending along the axis L of the body 50, an introduction passage 325 formed through a guide member 320 of the electromagnetic valve 300, a central hole 350*a* formed through a spacer 350 (later described), a passage 31*a* formed through the spring holder 31, a passage 33*a* formed through the spacer 33, and a passage 34*a* formed in the injection nozzle 34**.

A guide hole **34*c* is formed in the injection nozzle 34 and extends along the axis L of the body 50, and a needle valve 38 is slidably received in the guide hole 34*c*. The upper portion of the needle valve 38 is greater in diameter than its lower portion, and the needle valve 38 has a pressure receiving portion 38*a* interconnecting the upper and lower portions. The pressure receiving portion 38*a* is exposed to an oil reservoir chamber 34*d* provided at a mid portion of the passage 34*a* of the injection nozzle 34**.

The needle valve 38 is urged downward by a coil spring 39 which is received in a receptive hole **31*c* formed in the spring holder 31 and opening to the lower surface of the spring holder 31. The upper end of the spring 39 acts on the upper surface of the receptive hole 31*c* through a shim 39*a*. A projection 38*b* is formed on the upper end of the needle valve 38, and extends along the axis L of the body 50. The projection 38*b* extends through a hole 33b formed through the spacer 33, and is disposed adjacent to the receptive hole 31c. A spring retainer 39b is fixedly mounted on the upper end of the projection 38b, and receives the lower end of the spring 39**.

Under the influence of the spring 39, the needle valve 38 is held against a valve seat 34e formed on the injection nozzle 34 in the vicinity of the injection ports 34b, thereby closing the injection ports 34b. The pressure receiving from the pump chamber 24, and when this fuel pressure exceeds a set pressure determined by the spring 39, the needle valve 38 rises or lifts against the bias of the spring 39 to open the injection ports 34b, thereby injecting the fuel of high pressure from the injection ports 34b.

A valve receiving chamber 36 (see FIG. 5) is formed in the upper surface of the spring holder 31, and a disc-shaped check valve 37 is received within the valve receiving chamber 36. The check valve 37 prevents a pressure drop in the fuel pressure in the passage 34a of the injection nozzle 34 when terminating the fuel injection operation, as later described.

That portion of the internal space or interior of the retainer 52 disposed between the base member 51 and the spring holder 31 serves as a low pressure chamber 315 of the electromagnetic valve 300. The peripheral wall of the retainer 52 delimiting the low pressure chamber 315 serves as a casing of the electromagnetic valve 300. A leakage passage 51b is formed in the base member 51, and communicates a leakage prevention groove 28 with the low pressure chamber 315.

Stepped fuel inlet ports 52a are formed through that portion of the peripheral wall of the retainer 52 disposed below the low pressure chamber 315. A filter 52d is received in each of the fuel inlet ports 52a. The fuel inlet ports 52a communicate with a fuel supply pump P via an annular space (not shown) formed by an annular groove 52c in the outer peripheral surface of the retainer 52 and the inner peripheral surface of the above-mentioned sleeve (not shown) surrounding the retainer 52, a communication passage (not shown) formed in the sleeve, a communication passage (not shown) formed in the cylinder head, and a pipe (not shown) connected to the cylinder head.

Fuel outlet ports 52b are formed through that portion of the peripheral wall of the retainer 52 delimiting the low pressure chamber 315. The fuel outlet ports 52b communicate with a fuel tank T via an annular space (not shown) formed between an annular groove 52e in the outer peripheral surface of the retainer 52 and the inner peripheral surface of the sleeve surrounding the retainer 52, a communication passage (not shown) formed in the sleeve, a communication passage (not shown) formed in the cylinder head, and a pipe (not shown) connected to the cylinder.

The fuel in the fuel tank T is fed to the fuel inlet ports 52a by the fuel pump P, and is further supplied to the low pressure chamber 315 via an annular space 45 formed between the spring holder 31 and the retainer 52, a passage 31b formed in the upper end portion of the spring holder 31 and a hole 350b formed in the spacer 350. Then, this fuel is discharged from the fuel outlet ports 52b into the tank T. Therefore, the low pressure chamber 315 constitutes part of the fuel circulation supply system. A pressure regulating valve is provided in the fuel discharge passage connecting the fuel outlet ports 52b to the tank T so that the fuel supply pressure of a predetermined level can be applied to the low pressure chamber 315.

The fuel outlet ports 52b and the above fuel discharge passage may be omitted.

Next, the electromagnetic valve 300 will now be described particularly with reference to FIG. 5. The electromagnetic valve 300 comprises a guide member 320 which has a cylindrical stem portion 321 disposed coaxially with the body 50. The guide member 320 and the spacer 350 disposed below the guide member 320 are interposed between the base member 51 and the spring holder 31. When the retainer 52 is to be threaded onto the base member 51, a shoulder 52x (see FIG. 4) formed on the inner peripheral surface of the retainer 52 abuts against an annular projection 31x formed on the outer peripheral surface of the upper portion of the spring holder 31, and urges the spring holder 31 upward, so that the base member 51, the guide member 320, the spacer 350 and the spring holder 31 are brought into intimate contact with one another.

An annular projection or flange 322 is formed on the outer peripheral surface of the stem portion 321 of the guide member 320 intermediate the opposite ends of the stem portion 321. The annular projection 322 has a lower surface 323 which is tapered, and the tapered lower surface 323 serves as a valve seat. An annular recess 324 is formed in the outer peripheral surface of the stem portion 321 and is disposed immediately adjacent to the valve seat 323. The introduction passage 325 is formed axially through the stem portion 321 and hence extends from its upper to lower surface along the axis of the stem portion 321. The introduction passage 325 communicates at its upper end with the pump chamber 24 via the passage 51a formed in the base member 51. Also, the introduction passage 325 communicates at its lower end with the injection ports 34b, and communicates intermediate the opposite ends thereof with the annular recess 324 via a transverse hole 326 formed radially through the stem portion 32.

A valve member 330 having a tubular portion 331 is disposed in the lower portion of the low pressure chamber 315. The tubular portion 331 is slidably fitted on the lower section of the stem portion 321 of the guide member 320. An annular armature 335 is formed on and extends substantially radiallly outwardly from the upper end of the tubular portion 331. The inner portion of the armature 335 disposed adjacent to the tubular portion 331 has an upper surface of a tapered shaped which increases in diameter progressively upwardly. The angle of inclination of this tapered surface with respect to the axis L of the body 50 is either equal to or greater than the angle of inclination of the valve seat 323. With this arrangement, either the whole of the tapered surface or the inner peripheral edge of the tapered surface serves as an abutment portion 337 which is brought into and out of contact with the valve seat 323. Holes 335a are formed through the armature 335 so as to reduce the resistance offered by the fuel in the low pressure chamber 315.

A stator 341 of an electromagnetic drive means 340 is mounted at the upper portion of the low pressure chamber 315. The stator 341 has an annular shape, and is fixedly fitted on the upper section of the stem portion 321 of the guide member 320 extending upwardly from the annular projection 322. The lower surface of the stator 341 faces the armature 335 of the valve member 330, and a solenoid 343 is embedded in the armature 335.

An annular spring retainer 328 is fixedly mounted on the outer peripheral surface of the tubular portion 331 of the valve member 330 adjacent to the lower end thereof. A tubular member 339 is threadedly connected to the upper end of the spring holder 31 directed toward the low pressure chamber 315. An annular spring retainer 339*a* extends radially inwardly from the upper end of the tubular member 339. The spring retainer 339*a* is disposed between the armature 335 and the spring retainer 328. A compression coil spring 342 extends between the two spring retainers 339*a* and 328 in surrounding relation to the valve member 330, and urges the valve member 330 downward.

Figure 5:
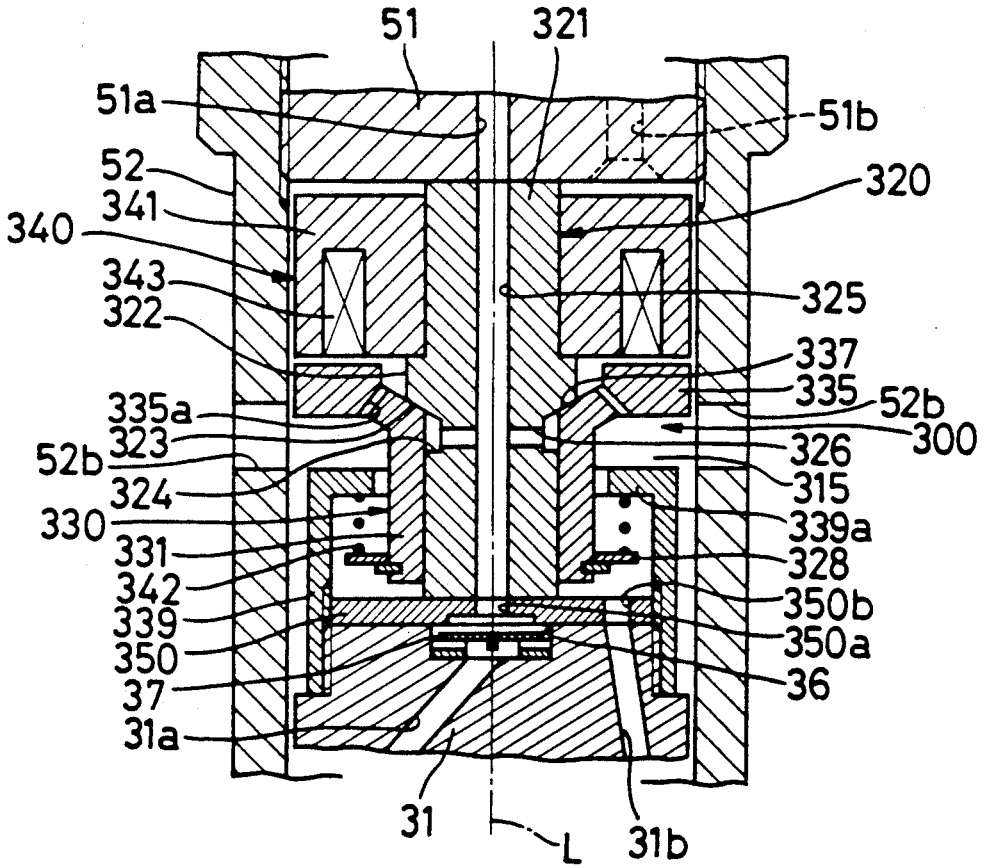
FIG. 5 is a cross-sectional view of an electromagnetic valve incorporated in the unit fuel injector of FIG. 4.

In the unit fuel injector shown in FIGS. 4 and 5, during the upward movement or stroke of the plunger 23, the solenoid 343 is de-energized, and the lower end of the valve member 330 is held against the spacer 350 under the influence of the spring 342, with the abutment portion 337 of the valve member 330 disengaged from the valve seat 323. Therefore, the fuel in the low pressure chamber 315 is suctioned into the pump chamber 24 via the annular space between the valve seat 323 and the abutment portion 337, the annular recess 324, the transverse hole 326, the introduction passage 325 and the passage 51*a* of the base member 51.

When the solenoid 343 is energized during the downward stroke of the plunger 23, an electromagnetic force produced in the solenoid 343 causes the valve member 330 to move upward against the bias of the spring 342, so that the abutment portion 337 is brought into engagement with the valve seat 323. As a result, the communication between the introduction passage 325 and the low pressure chamber 315 is interrupted. Therefore, when the plunger 23 subsequently moves downward, the fuel pressure in the fuel feed passage 40 including the pump chamber 24 and the introduction passage 325 increases, thereby starting the fuel injection operation.

Thereafter, when the solenoid 343 is de-energized during the downward stroke of the plunger 23, the valve member 330 is moved downward under the influence of the spring 342, so that the abutment portion 337 is disengaged from the valve seat 323, thereby spilling the fuel of high pressure from the introduction passage 325 into the low pressure chamber 315. As a result, the pressure within the fuel reservoir portion 34*d* decreases, so that the needle valve 38 is brought into engagement with the valve seat 34*e* under the influence of the spring 39, thereby terminating the fuel injection operation.

Unlike the conventional unit fuel injections, the unit fuel injector shown in FIGS. 4 and 5 is not provided with a long spill passage for communicating the pump chamber with the spill chamber (low pressure chamber). Therefore, a dead space which prevents the fuel from being pressurized to a high level can be kept to a minimum, and the fuel can be pressurized to a higher level. Further, because of the omission of such a spill passage, the unit fuel injector of the present invention can be simpler in construction and therefore can be manufactured at lower costs.

Further, the low pressure chamber 315 constituting part of the fuel supply system is provided at the intermediate portion of the cylindrical body 50, and the fuel inlet and outlet ports 52*a* and 52*b* communicating with the low pressure chamber 315 are formed through the peripheral wall of the body 50. With this arrangement, the passages for the fuel supply and discharge system can be much simplified.

Further, since the unit fuel injector extends straight, and does not have any large projection radially outwardly extending from the outer peripheral surface of the body, the space required for installing the fuel injector can be saved.

Incidentally, if there is provided a spill passage opening at one end to the peripheral surface of the pump chamber 24 and obliquely intersecting the axis L of the body 50, as is the case with the conventional unit fuel injectors, an acute-angle portion is formed at that portion of the peripheral surface of the pump chamber 24 where the one end of the spill passage is provided. It is possible that such an acute-angle portion may be subjected to fatigue fracture. However, the fuel injector of FIG. 4 is not provided with such a spill passage and hence such an acute-angle portion.

While the present invention has been specifically described and shown herein, the invention itself is not to be restricted to the exact showing of the drawings or the description thereof, and various modifications can be made. For example, the valve member may be urged toward the valve seat by the coil spring, and the valve member may be moved away from the valve seat by the solenoid.

Further, the use of the electromagnetic valve according to the present invention is not limited to the unit fuel injectors, and it is applicable to any other suitable devices which require the spilling of a high-pressure fluid.

What is claimed is:

1. An electromagnetic valve comprising:

(a) a casing having an internal space serving as a low pressure chamber;

(b) a guide member mounted within said casing and having a cylindrical stem portion and a valve seat disposed radially outwardly of said stem portion, said stem portion having an introduction passage extending along an axis of said stem portion so as to receive a high-pressure fluid, and a communication passage leading said introduction passage to said valve seat;

(c) a valve member having a tubular portion which is fitted on said stem portion for sliding movement therealong in a direction of the axis of said guide member, said tubular portion having at one end an abutment portion disposed in opposed relation to said valve seat, said valve member being movable along the axis of said guide member between a closed position where said abutment portion is held in contact with said valve seat to interrupt the communication between said introduction passage and said low pressure chamber and an open position where said abutment portion is held out of contact with said valve seat to communicate said introduction passage with said low pressure chamber via said communication passage, and the high-pressure fluid in said introduction chamber being spilled into said low pressure chamber during the time when said valve member is moved from its closed to open position; and (d) electromagnetic drive means for controlling the movement of said valve member, said electromagnetic drive means including a spring urging said valve member in one of a direction toward said closed position and a direction away from said closed position, and a solenoid for urging said valve member in the other direction.

2. An electromagnetic valve according to claim 1, in which said valve seat of said guide member has an annular shape, said abutment portion of said valve member having an annular shape, and said communication passage of said guide member including an annular recess formed in the outer peripheral surface of said stem portion and disposed adjacent to said valve seat, and a transverse hole extending generally radially of said stem portion and communicating said introduction passage with said annular recess.

3. An electromagnetic valve according to claim 2, in which said guide member has a head of a circular cross-section formed on one end of said stem portion disposed adjacent to said annular recess, said head being greater in diameter than said stem portion, that portion of the outer peripheral surface of said stem portion close to said annular recess serving as said valve seat of an annular shape, and said introduction passage extending from that portion of said stem portion adjacent to said head to an end face of said stem portion remote from said head.

4. An electromagnetic valve according to claim 3, in which said valve member has an auxiliary tubular portion which is greater in diameter than said head and is disposed in surrounding relation to said head, said auxiliary tubular portion having a hole formed therethrough for communicating said annular recess with said low pressure chamber when said valve member is in its open position, said valve member also having a funnel-shaped connective portion coaxial with said tubular portion and said auxiliary tubular portion and interconnecting them at their one ends, said valve member further having an annular armature extending generally radially inwardly and outwardly from the other end of said auxiliary tubular portion remote from said connective portion, said spring of said electromagnetic drive means acting on an inward portion of said armature, disposed radially inwardly of said auxiliary tubular portion, to urge said valve member toward its open position, and an electromagnetic force, produced in said solenoid of said electromagnetic drive means, acting on said armature to move said valve member toward its closed position against the bias of said spring.

5. An electromagnetic valve according to claim 2, in which an annular recess is formed in the inner peripheral surface of said tubular portion of said valve member and is disposed in opposed relation to said annular recess in said guide member, whereby immediately said abutment portion of said valve member is disengaged from said valve seat to allow the high-pressure fluid to be spilled from said introduction passage of said guide member into said low pressure chamber, the pressure in said annular recess becomes lower progressively toward said valve seat to produce a pressure gradient, thereby producing a propelling force to move said valve member toward its open position.

6. An electromagnetic valve according to claim 2, in which said valve member has an annular armature extending generally radially outwardly from the one end of said tubular portion, whereby immediately said abutment portion of said valve member is disengaged from said valve seat, the high-pressure fluid spilled from said introduction passage of said guide member toward said low pressure chamber acts on a surface of said armature facing said valve seat, so that a propelling force to move said valve member to its open position is applied to said valve member.

7. An electromagnetic valve according to claim 6, in which a first annular spring retainer is fixedly mounted on said tubular portion of said valve member, a second annular spring retainer being mounted on said casing and disposed between said first spring retainer and said armature, and said spring of said electromagnetic drive means acting between said first and second spring retainers.

8. An electromagnetic valve according to claim 2, in which said introduction passage extends axially through said guide member from one end of said guide member to the other end thereof, said introduction passage communicating intermediate opposite ends thereof with said annular recess via said transverse hole.

9. An electromagnetic valve according to claim 8, in which said valve seat of an annular shape is formed on the outer peripheral surface of said stem portion of said guide member intermediate the opposite ends of said stem portion, said stem portion being divided by said valve seat into a first section and a second section, said valve seat being directed toward said first section, said tubular portion of said valve member being slidably fitted on said first section, said valve member having an annular armature extending radially outwardly from the one end of said tubular portion, and said solenoid of said electromagnetic drive means facing said armature and being disposed in surrounding relation to said second section of said stem portion.

10. A unit fuel injector comprising:

(a) a body;

(b) pump means mounted on said body, said pump means including a cylinder hole formed in said body, and a plunger received in said cylinder hole for reciprocal movement therealong to achieve a pump stroke and a suction stroke, a pump chamber being defined by said cylinder hole and said plunger;

(c) injection nozzle means mounted on said body and including an injection port connected to said pump chamber, and a valve for controlling the communication between said pump chamber and said injection port, said valve being opened when the pressure of fuel within said pump chamber is increased to a predetermined level during said pump stroke, thereby injecting the fuel from said injection port; and (d) an electromagnetic valve mounted on said body and including (i) a low pressure chamber formed in said body; (ii) a guide member mounted within said low pressure chamber and having a cylindrical stem portion and a head of a circular cross-section which is formed on one end of said stem portion and is greater in diameter than said stem portion, that surface of said head close to said stem portion serving as an annular valve seat, an end face of said stem portion remote from said head being abutted against part of a surface defining said low pressure chamber, said stem portion having an introduction passage extending along an axis of said stem portion, said introduction passage having one end disposed in the vicinity of said head, said introduction passage opening at the other end to said end face of said stem portion, the other end of said introduction passage communicating with said pump chamber via a spill passage formed in said body so that a high-pressure fluid from said pump chamber can be introduced into said introduction passage, and said stem portion having an annular recess formed in the outer peripheral surface thereof adjacent to said head, and a transverse hole extending generally radially of said stem portion and communicating the one end of said introduction passage with said annular recess; (iii) a valve member having a tubular portion which is fitted on said stem portion for sliding movement therealong in a direction of the axis of said guide member, said tubular portion having at one end an annular abutment portion disposed in opposed relation to said annular valve seat, said valve member being movable along the axis of said guide member between a closed position where said abutment portion is held in contact with said valve seat to interrupt the communication between said introduction passage and said low pressure chamber and an open position where said abutment portion is held out of contact with said valve seat to communicate said introduction passage with said low pressure chamber via said transverse hole and said annular recess, whereby immediately said valve member moves from its close position toward its open position during the pump stroke of said plunger, the high-pressure fluid in said pump chamber is spilled into said low pressure chamber via said introduction passage, said transverse hole and said annular recess, thereby terminating the injection of the fuel from said injection port; and (iv) electromagnetic drive means for controlling the movement of said valve member, said electromagnetic drive means including a coil spring urging said valve member in one of a direction toward said closed position and a direction away from said closed position, and a solenoid for urging said valve member in the other direction.

11. A unit fuel injector comprising:

(a) a linearly-extending body;

(b) pump means mounted on one end portion of said body, said pump means including a cylinder hole formed in said body and extending along the axis of said body, and a plunger received in said cylinder hole for reciprocal movement therealong to achieve a pump stroke and a suction stroke, a pump chamber being defined by said cylinder hole and said plunger, said plunger being generally coaxial with said body;

(c) injection nozzle means mounted on the other end portion of said body, said injection nozzle means including a nozzle extending along the axis of said body and having at its distal end an injection portion connected to said pump chamber via a fuel feed passage, and a vale for controlling the communication between said pump chamber and said injection port, said valve being opened when the pressure of fuel within said pump chamber is increased to a predetermined level during said pump stroke, thereby injecting the fuel from said injection port; and (d) an electromagnetic valve mounted within said body so as to spill the high-pressure fuel from said pump chamber, said electromagnetic valve being disposed on the axis of said body and being disposed between said pump means and said injection nozzle means;

wherein said electromagnetic valve comprises (i) a low pressure chamber formed in said body intermediate the opposite end portions of said body;

(ii) a guide member mounted within said low pressure chamber and having a stem portion and an annular valve seat disposed radially outwardly of said stem portion, said stem portion having an introduction passage extending along an axis of said stem portion, said introduction passage communicating with said fuel feed passage so that the high-pressure fuel from said pump chamber can be introduced into said introduction passage, and said stem portion having a communication passage leading from said introduction passage to said valve seat;

(iii) a valve member having a tubular portion which is fitted on said stem portion for sliding movement along said stem portion in a direction of the axis of said guide member, said tubular portion having at one end an annular abutment portion disposed in opposed relation to said annular valve seat, said valve member being movable along the axis of said guide member between a closed position where said abutment portion is held in contact with said valve seat to interrupt the communication between said introduction passage and said low pressure chamber and an open position where said abutment portion is held out of contact with said valve seat to communicate said introduction passage with said low pressure chamber via said communication passage, whereby as soon as said valve member moves from its closed position toward its open position during the pump stroke of said plunger, the high-pressure fluid in said pump chamber is spilled into said low pressure chamber via said introduction passage and said communication passage, thereby terminating the injection of the fuel from said injection portion; and (iv) electromagnetic drive means for controlling the movement of said valve member, said electromagnetic drive means comprising a spring urging said valve member in a direction either toward said closed position or away from said closed position and a solenoid for urging said valve member in a direction opposite to the direction in which the coil spring urges said valve member.

12. A unit fuel injector comprising:

(a) a linearly-extending body which is cylindrical throughout its entire length;

(b) pump means mounted on one end portion of said body, said pump means including a cylinder hole formed in said body and extending along the axis of said body, and a plunger received in said cylinder hole for reciprocal movement therealong to achieve a pump stroke and a suction stroke, a pump chamber being defined by said cylinder hole and said plunger, said plunger being generally coaxial with said body;

(c) injection nozzle means mounted on the other end portion of said body, said injection nozzle means including a nozzle extending along the axis of said body and having at its distal end an injection port connected to said pump chamber via a fuel feed passage, and a valve for controlling the communication between said pump chamber and said injection port, said valve being opened when the pressure of fuel within said pump chamber is increased to a predetermined level, thereby injecting the fuel from said injection port; and (d) an electromagnetic valve mounted within said body so as to spill the high-pressure fuel from said pump chamber, said electromagnetic valve being disposed on the axis of said body between said pump means and said injection nozzle means;

wherein said electromagnetic valve comprises:

(i) a low pressure chamber formed in said body intermediate the opposite end portions of said body;

(ii) a guide member mounted within said low pressure chamber and having a stem portion extending along the axis of said body, and an annular valve seat formed on the outer peripheral surface of said stem portion, said guide member having an introduction passage formed axially therethrough, said introduction passage constituting part of said fuel feed passage and communicating at its one end with said pump chamber and communicating at its other end with said injection port so that the high-pressure fuel from said pump chamber can be introduced into said introduction passage, and said stem portion having an annular recess formed in the outer peripheral surface thereof adjacent to said valve seat, and a transverse hole extending generally radially of said stem portion and communicating said annular recess with said introduction passage;

(iii) a valve member having a tubular portion which is fitted on said stem portion for sliding movement therealong in a direction of the axis of said guide member said tubular portion having at one end an annular abutment portion disposed in opposed relation to said annular valve seat, said valve member being movable along the axis of said guide member between a closed position where said abutment portion is held in contact with said valve seat to interrupt the communication between said introduction passage and said low pressure chamber and an open position where said abutment portion is held out of contact with said valve seat to communicate said introduction passage with said low pressure chamber via said transverse hole and said annular recess, whereby as soon as said valve member moves from its close position toward its open position during the pump stroke of said plunger, the high-pressure fluid in said pump chamber is spilled into said low pressure chamber via said introduction passage, said transverse hole and said annular recess, thereby terminating the injection of the fuel from said injection port; and (iv) electromagnetic drive means for controlling the movement of said valve member, said electromagnetic drive means comprising a coil spring urging said valve members in a direction either toward said closed position or away from said closed position, and a solenoid for urging said valve member in a direction opposite to the direction in which the coil spring urges said valve member.

13. A unit fuel injector according to claim 12, in which said body has a peripheral wall, a fuel inlet port being formed through said peripheral wall of said body, the fuel being fed from said fuel inlet port to said low pressure chamber, said valve member of said electromagnetic valve being disposed in its open position during the suction stroke of said plunger, so that the fuel in said low pressure chamber is fed to said pump chamber via said annular recess, said transverse hole and said introduction passage.

14. A unit fuel injector according to claim 13, in which a fuel outlet port is formed through said peripheral wall of said body and communicates with said low pressure chamber.

* * * * *

UNITED STATES PATENT AND TRADEMARK OFFICE

CERTIFICATE OF CORRECTION

PATENT NO. : 5,082,180

DATED : January 21, 1992

INVENTOR(S) : Ken-ichi Kubo, et al

It is certified that error appears in the above-identified patent and that said Letters Patent is hereby corrected as shown below:

Column 19,

In claim 11, paragraph (c), line 6, replace "vale" with --valve--.

Signed and Sealed this

Twenty-second Day of June, 1993

*Attest:*

*Attesting Officer*

Michael K. Kirk

MICHAEL K. KIRK

*Acting Commissioner of Patents and Trademarks*